US008579615B2

(12) United States Patent
Akmandor

(10) Patent No.: US 8,579,615 B2
(45) Date of Patent: Nov. 12, 2013

(54) PIVOTING, HINGED ARC VANE ROTARY COMPRESSOR OR EXPANDER

(75) Inventor: Ibrahim Sinan Akmandor, Ankara (TR)

(73) Assignee: Pars Makina Sanayi Ve Ticaret Limited Sirketi, Ankara (TR)

( * ) Notice: Subject to any disclaimer, the term of this patent is extended or adjusted under 35 U.S.C. 154(b) by 207 days.

(21) Appl. No.: 13/037,506

(22) Filed: Mar. 1, 2011

(65) Prior Publication Data

US 2012/0224989 A1 Sep. 6, 2012

(51) Int. Cl.
*F01C 21/06* (2006.01)
*F03C 2/00* (2006.01)
*F03C 4/00* (2006.01)

(52) U.S. Cl.
USPC ..... 418/84; 418/12; 418/86; 418/151; 418/237; 418/249

(58) Field of Classification Search
USPC ..... 418/5, 12, 151, 84–86, 236–238, 243, 418/248–250, 259, 270
See application file for complete search history.

(56) References Cited

U.S. PATENT DOCUMENTS

| | | | | | |
|---|---|---|---|---|---|
| 40,008 | A | | 9/1863 | Adancourt | |
| 832,848 | A | | 10/1906 | Croston | |
| 1,269,303 | A | * | 6/1918 | Pardon | 418/151 |
| 1,681,574 | A | * | 8/1928 | Farmer | 418/84 |
| 1,913,657 | A | * | 6/1933 | Buchanan et al. | 418/151 |
| 1,968,537 | A | * | 7/1934 | Gerhardt | 418/212 |
| 2,458,620 | A | | 1/1949 | Megeber | |
| 3,193,192 | A | | 7/1965 | Carter, Jr. | |
| 4,011,033 | A | | 3/1977 | Christy | |
| 4,019,840 | A | | 4/1977 | Christy | |
| 4,060,342 | A | | 11/1977 | Riffe | |
| 4,061,450 | A | | 12/1977 | Christy | |
| 4,073,608 | A | | 2/1978 | Christy | |
| 5,007,813 | A | | 4/1991 | Da Costa | |
| 5,163,825 | A | | 11/1992 | Oetting | |
| 5,188,524 | A | | 2/1993 | Bassine | |
| 5,616,020 | A | | 4/1997 | Firestone | |
| 5,692,887 | A | | 12/1997 | Krueger et al. | |
| 5,716,201 | A | | 2/1998 | Peck et al. | |
| 6,125,814 | A | | 10/2000 | Tang | |
| 6,371,745 | B1 | | 4/2002 | Bassine | |
| 6,868,822 | B1 | | 3/2005 | Di Pietro | |
| 7,117,841 | B2 | | 10/2006 | Kernes | |
| 7,231,894 | B2 | * | 6/2007 | Driver | 418/248 |
| 7,314,035 | B2 | | 1/2008 | Akmandor et al. | |
| 7,597,548 | B2 | * | 10/2009 | Patterson | 418/268 |
| 2003/0159673 | A1 | | 8/2003 | King | |

FOREIGN PATENT DOCUMENTS

| | | |
|---|---|---|
| TR | 2006 03859 | 9/2006 |
| TR | 2005 02164 | 2/2008 |

* cited by examiner

*Primary Examiner* — Theresa Thrieu
(74) *Attorney, Agent, or Firm* — Gokalp Bayramoglu

(57) ABSTRACT

A rotary compressor or expander include a cylindrical housing chamber, a rotatable cylindrical rotor mounted eccentrically with respect to housing chamber center, a cylindrical rotor liner free to move around the rotor, and a pivoting generally circular arc vane hinged to the rotor liner. Cavity or buckets engraved to the outer surface of the rotor liner together with corresponding inlet nozzle flow provide additional momentum impulse transfer from working fluid to expander eccentric rotor. The inlet of the rotary expander is equipped with a rotating valve synchronous to the eccentric rotor, regulating the admission time and duration of the entering working fluid. The exhaust of the rotary compressor is equipped with either a check valve or a rotating valve synchronizing the fluid discharge time and duration.

6 Claims, 12 Drawing Sheets

PIVOTING, HINGED ARC VANE ROTARY COMPRESSOR OR EXPANDER

FIELD OF THE INVENTION

This invention relates to energy systems and more particularly to rotating componentry enabling shaft work, propulsion drive, electric power generation, jet propulsion and thermodynamic systems such as ventilation, cooling, heat, pressure or vacuum generating systems. The invention mainly pertains to the art of vane assemblies for eccentrically rotating partial admission compressors and expanders that may either be used together or in conjunction with other mechanical, electrical, hydraulic or pneumatic machineries. Of particular interest is the innovative fluid energy recovery mechanical devices targeting the field of gas turbine engines, internal combustion engines, hydraulic turbines and refrigeration expansion nodes.

BACKGROUND

Since the start of the industrial revolution, the reciprocating piston engine and, the gas turbine engine have largely dominated the energy and transportation market. Despite many years of research and technological innovations and investments, these engines simple cycle thermal efficiencies are still below 50% and very far from the ideal Carnot cycle theoretical efficiency figure. As a result, these engines needs auxiliary energy recovery devices such as turbochargers, regenerative heat transfer systems or other topping or bottoming combined heat and power cycles to boost their powers and increase their thermal efficiencies. On the other side, for many years, patents on rotary vane combustion engines have claimed that rotary engines possess many advantages over reciprocating engines such as having higher power density, fewer parts, lower weight and fewer reciprocating imbalance. Indeed rotary engines aero thermodynamic configuration naturally bridges the mass flow and rotational speed gaps between reciprocating and gas turbine engines. But for rotary vane compressor and expander engine components to appear on the commercial market firstly seal and wear problems must be adequately addressed. The present invention addresses and eliminates the main problems related with friction, wear, seal, balance and aerodynamic drag that limit the use of single vane rotary compressor and expanders.

In today's industrial applications, rotary compressor and expander features single or multiple vanes that are slidably mounted in generally radial slots in the rotor. The rotor itself is eccentrically mounted in a chamber formed in the compressor or expander housing. The centrifugal force urges the vanes outwardly from their slots to engage the wall of the chamber. Wear of the vane result from this outward force and from the surface contact velocity. The vanes form successive compartments that collect air that is introduced into the compressor or expander. As the vane rotates, the working fluid is moved into a gradually constricted or expanding portion of the chamber where it is either compressed or expanded respectively. This working fluid is then delivered through an exhaust port. Conventional vane rotary devices exhibit at least a couple of significant problems. As each vane slides back and forth within its respective slot, a considerable amount of heat is generated. The friction resulting from such sliding causes the vanes to wear prematurely and leads to loss of performance. As a result, these types of devices require frequent maintenance. Moreover due to constant wear on the vanes, known rotary compressors and expanders are very likely to exhibit gaps at the contact region between the end tips of the vanes and the chamber wall. This can result in fluid leakage which may significantly impair the operation of the compressor or expander.

SUMMARY

The invention relates to a pivoting arc vane hinged to an eccentric rotor liner and a rotatable rotor placed within a cylindrical housing. Such configuration may be used either as a compressor or an expander. Each of these housing is receiving an eccentrically placed rotor liner equipped by a single pivoting vane, all arranged around an eccentric rotor. Within each housing, depending on the rotational position of the pivoting vane, forms a plurality of working chambers each of the said chambers, delimited by the inner cylindrical peripheral surface of the housing, the outer peripheral surface of the rotor liner and the side surface of the hinged arc vane. Because rotary vane compressors or expanders are partial admission devices, they have low mass flow rate requirements and it also becomes extremely useful to equip such systems together with vapour heat generator, fluid pump and vapour condenser systems.

An object of the present invention is to provide an improved rotary compressor or a rotary expander that utilises a durable, wear resistant, frictionless pivoting single arc vane construction. Another object of the present invention is to provide a rotary vane compressor or expander which is efficient to use, yet cost effective in its manufacture.

Other features, advantages, and applications of the invention will be apparent from the following descriptions, the accompanying figures, and from the claims.

BRIEF DESCRIPTION OF THE DRAWINGS

The present invention is illustrated hereinafter through preferred and alternative embodiments wherein.

DETAILED DESCRIPTION OF EXEMPLARY EMBODIMENTS

One of the objects of this invention, is to increase compressors and expanders polytropic efficiencies above levels reached by today's rotating components. In compressors, this is achieved by realising high compression ratios with less shaft power input as high pressure compression phase is implemented progressively. In expanders, high efficiencies are achieved by processing the working fluid through a smoothly enlarging crescent shape constriction allowing a progressive longer power extraction phase. The hinged vane expander efficiently decreases fluid pressure and temperature so that superheated vapour may leave the expander at a thermo dynamical state closer to or below saturated liquid thus completely eliminating or at least allowing a smaller size vapour condenser. Another object of this invention is to provide a volume displacement compressor or expander geometry which has reduced rotor and vane wear characteristics and which substantially decreases the need for liquid lubricant. It is another object to provide an arc vane type with simple design and construction geometry and which can be manufactured at relatively low cost, and which also avoids the need for machining of elaborate intake and exhaust port structure.

All together, the present invention discloses an efficient, powerful, compact, simple and reliable hinged vane rotor liner and a rolling piston compressor or expander geometry. Such partial admission geometry provides high efficiency and "no-stall" characteristics even if the aerodynamic rotor liner may work with relatively low working flow volumes rates at high rotor speeds. The dimensions of hinged vanes compressors and turbines are of comparable size to radial compressors and turbines but they have a lighter weight as they are equipped with just a single vane and not a full row of blades.

Further exemplary of the invention is the provision of a single pivoting hinged vane structure in which the shear contact between the vane and the housing casing is eliminated without sacrificing working chamber pressure and flow seal performance. The plural use of vanes within the housing as described in prior arts leads to higher friction losses and a subsequent reduction of the rotary component efficiency. The plural use of vanes also increases the system complexity and cost.

Figure 1:
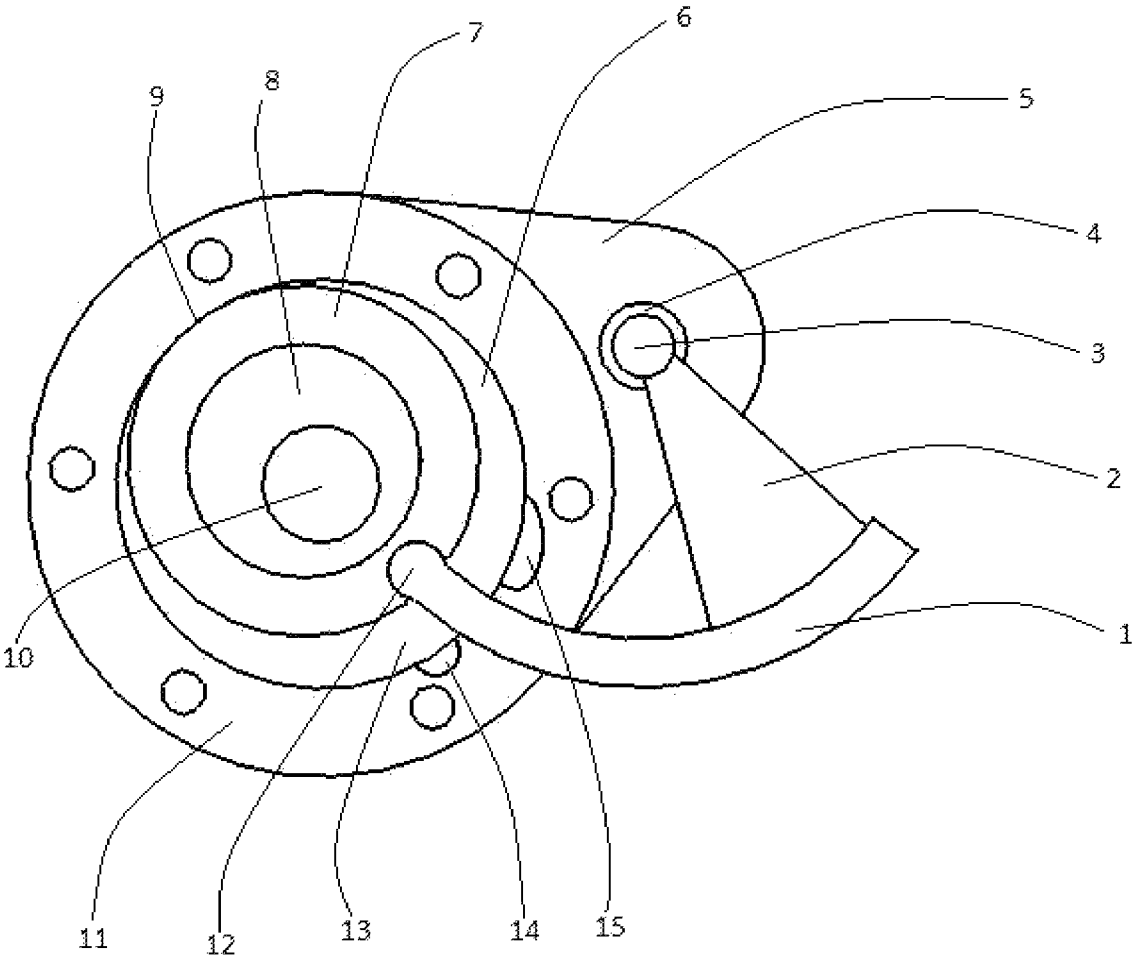
FIG. 1: Top view of pivoting arc vane compressor or expander device.

The above and other distinctive novel features of the present invention will be apparent from the following detailed description of specific embodiments of the apparatus when read in conjunction with the accompanying drawings, wherein FIG. 1 depicts top view of preferred embodiment of the pivoting hinged arc vane rotary compressor or expander device. A circularly cylindrical rotor (8) is rotatably and eccentrically mounted in the housing (11) chamber (13). The rotor (8) is rotating around main shaft centre axis (10) and it is circumferentially housed within a cylindrical rotor liner (7) which is hinged (12) to the arc vane (1) pivoting around pivot rod (3). The arc vane pivot rod is housed by the shaft bearing (4) fixed to housing side body (5). The arc vane (1) is rigidly connected to the pivoting rod (3) through arm (2) located at said pivoting rod mid height. As main shaft (10) is driven clockwise by an external motor—not shown—the rotary compressor breathes from the intake (14). First working chamber (13) is receiving the fluid from intake port (14), said fluid is either air, or any other working gas or vapour, or any other liquid-vapour mixture.

As the arc vane (1) cuts through the crescent-shape working volume of the compressor housing, a plurality of working chambers (13, 6) are sequentially created within the crescent shaped cavity delimited by rotor liner (7) outer cylindrical surface and housing (11) inner cylindrical peripheral. The first working chamber (13) accepts low pressure working fluid and the second working chamber (6) compresses the working fluid which was admitted within the housing by the first chamber (13) in the precedent 360° rotation of eccentric rotor (8). Said fluid is compressed by a continuously diminishing chamber working volume discharging to outlet port (15). Said constricted region is delimited by the rotor liner (7) outer cylindrical surface, the housing (11) inner peripheral cylindrical surface and the vane (1) arched side surface. The exhaust port (15) of such rotary compressor is equipped with a check valve or a rotating valve—not shown—that allows flow to discharge from rotary compressor device but strictly prevents any flow intake from exhaust port (15).

The rotary turbine unit is similar in component to the compressor unit but its geometric size and operation differ. The crescent shape cavity between the inner peripheral of the housing (11) and the outer surface of the rotor liner (7) is divided into two working chambers (13 and 6) by the pivoting vane (1) and the common tangency line (9) of two osculating surfaces, namely the rotor liner (7) outer boundary and the housing (11) cylindrical inner peripheral. Under the clockwise rotation of the eccentric rotor (8) a new working cycle starts every time the tangency line (9) passes by the inlet port (14). With the beginning of a new working cycle, the first working chamber (13) admits high pressure fluid from inlet port (14) and the working fluid expands in said chamber (13) as the eccentric rotor (8) rotates under the forcing torque and pressure of admitted fluid. In the consecutive 360° clockwise rotation which defines the second working cycle, the fully expanded working fluid which is now in the second working chamber (6) discharges through exhaust port (15). Under the rotational action of the eccentric rotor the working chambers (13,6) continuously change size. At each rotation of the rotor, both first and second working cycles are present at each side of tangency line (9) so that each rotation of the expander produces shaft power. The expansion pressure ratio of expander is dependent on working fluid inlet pressure, the amount of the mass flow through turbine and the maximum crescent shape working volume of said expander unit.

Figure 2:
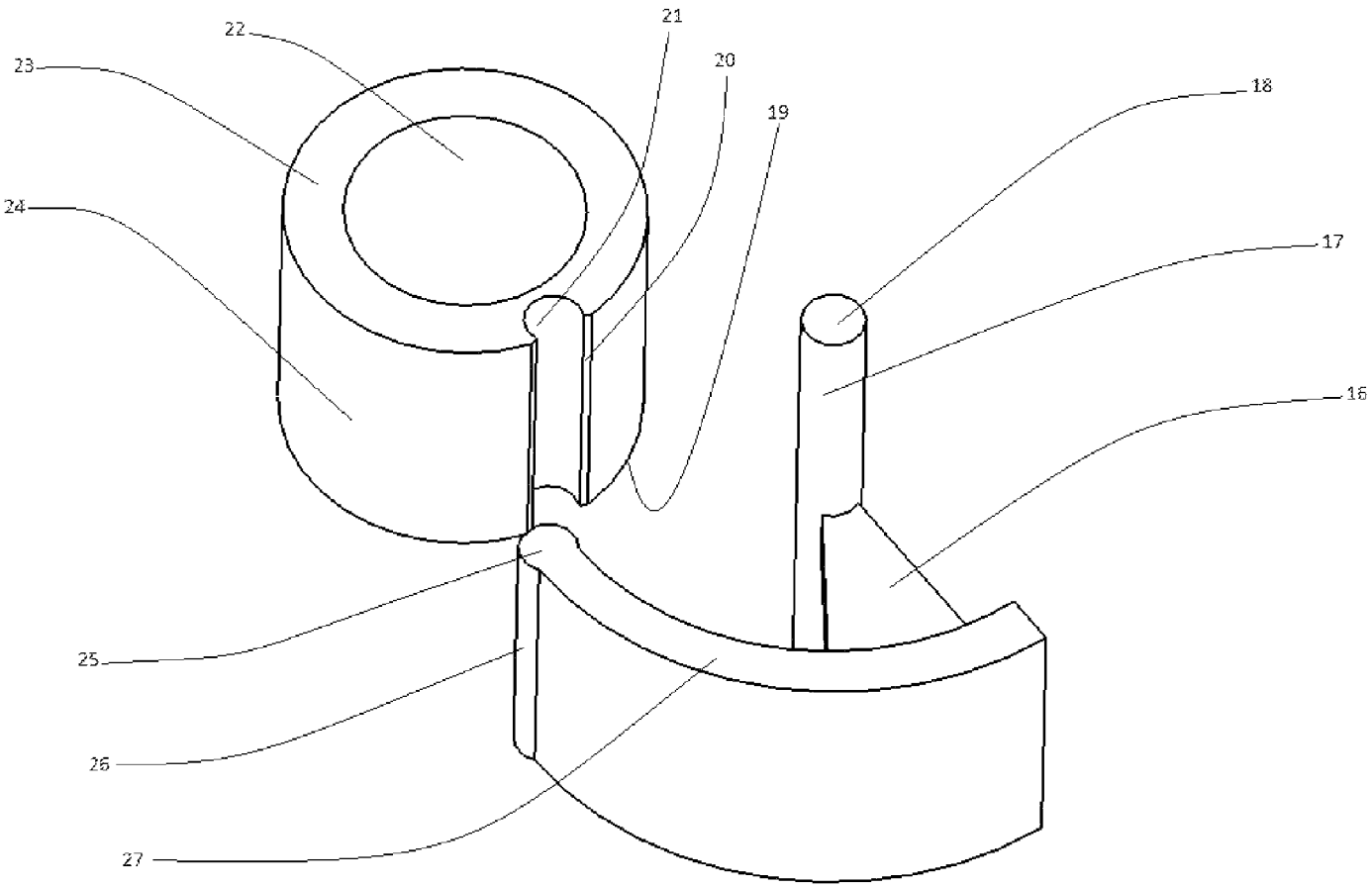
FIG. 2: Exploded view of centre-hold pivoting arc vane and hinge cavity on the rotor liner.

FIG. 2 depicts details of centre-hold (16) hinged (25) pivoting arc vane (27) and hinge cavity (21) on the rotor liner (24). The rotor liner (24) has a tubular shape (23) with a central cylindrical hole (22) that houses the rotor. The top (23) and bottom (19) surfaces are parallel to each other and their surfaces are fine polished to reduced any remaining working friction between rotor liner and top and bottom end plates. The height (26) of the arc vane is equal to the distance between the rotor liner (24) top and bottom faces (23 and 29). Hence rotor liner and arc vane top and bottom surfaces are flush mounted. The sides (20) of the hinge cavity (21) is contoured so as to allow for the pivot motion of the arc vane around the pivoting rod (17). Both pivot shaft rod end surfaces (18) are journalled in bearings supported by the housing casing (5). The arc vane pivot displacement parallel to the rod is strictly restricted. Hence the pivoting arc vane motion do not causes any friction with end plates (60,76).

Figure 3:
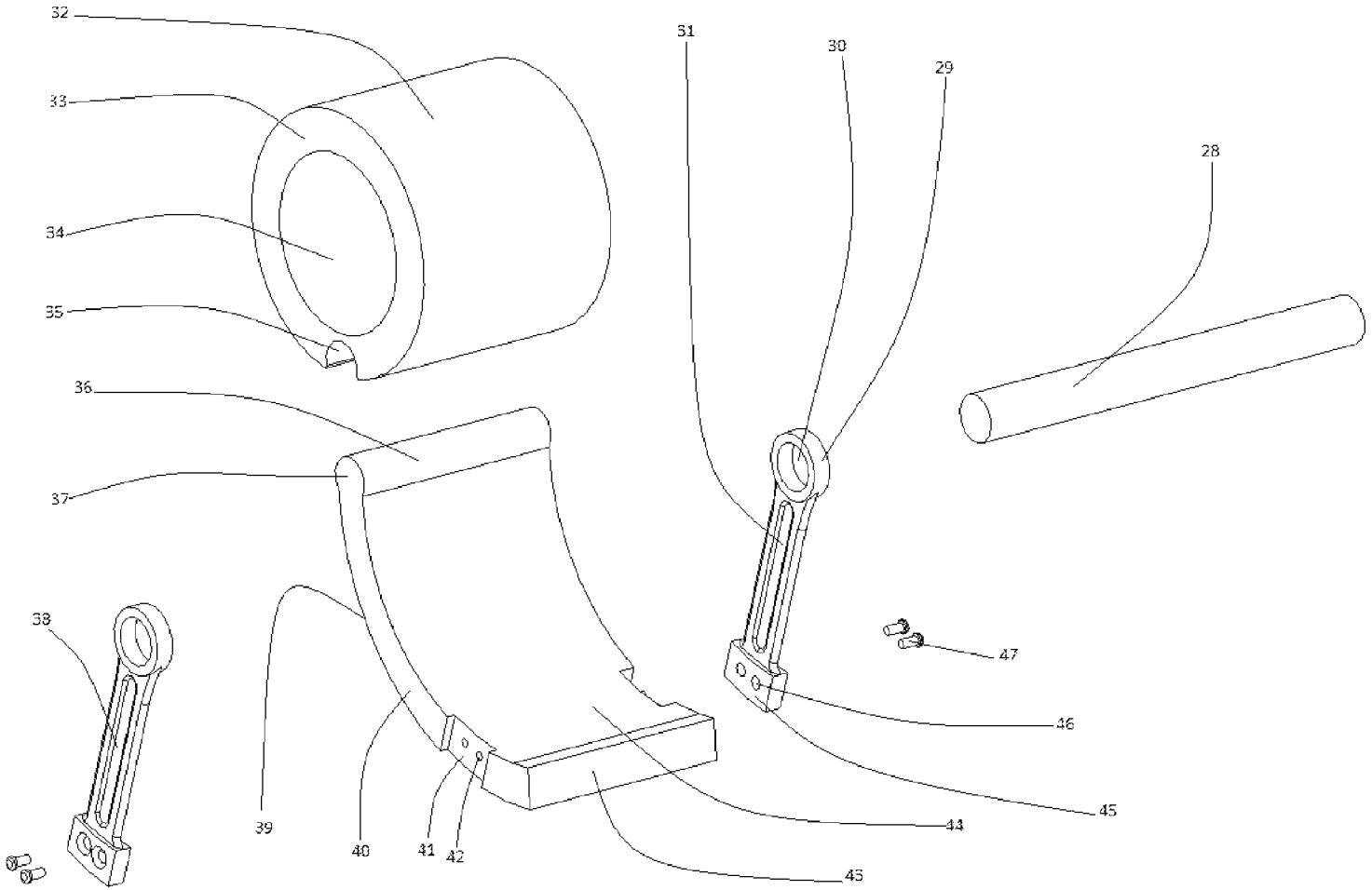
FIG. 3: Exploded view of pivoting arc vane, top-hold and bottom-hold pivot assembly and rotor liner.

FIG. 3 depicts a different preferred embodiment of the hinged arc vane (39), the pivot rod (28) that engages rigidly the two side arms (38 and 31) cylindrical (29) housing (30). The arc vane end surface (41) is rigidly linked to the pivot rod (28) and to both arms (38 and 31) face (45) with bolts (47) engaging through side arm holes (46) and tightened to vane threaded holes (42). Pivoting vane top surface (40) and arm face (45) are to be flush mounted. The vane hinge (37) engages over its entire height (36) the rotor liner (32) cavity (35) in such a way that rotor liner top surface (33) are flush mounted with arched (44) vane (39) top (40) and bottom surfaces. The rotor liner central hole (34) houses the rotor. The vane surface (43) opposite to hinge (37) may have an aerodynamic blunt nose shape to reduce aerodynamic resistance during the pivot motion of the vane.

Figure 4:
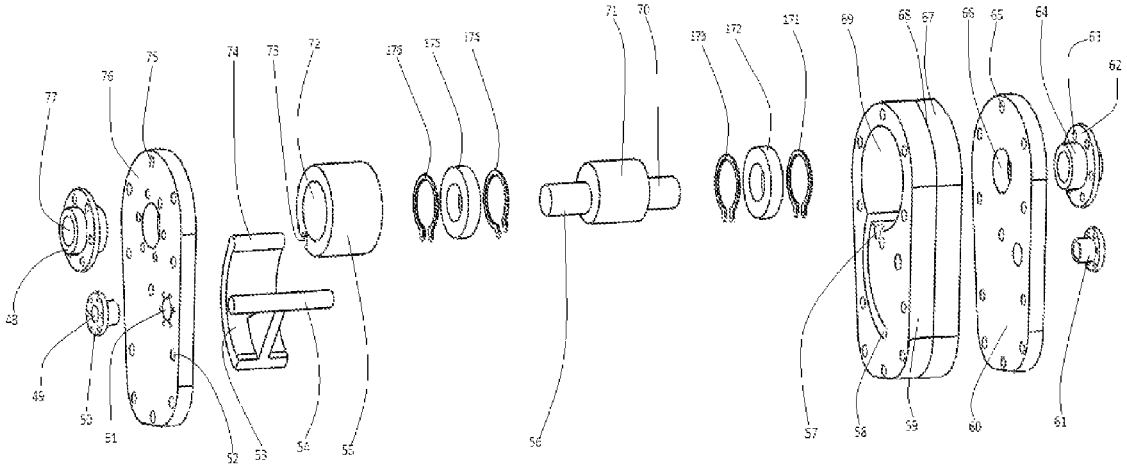
FIG. 4: Exploded view of pivoting arc vane compressor or expander device.

FIG. 4: depicts an exploded view of preferred embodiment of the pivoting hinged arc vane rotary compressor or expander device. The single rigid pivot (54) arc vane (53) which is sealingly mounted within the two part housing (59 and 67) slot (58). The arc vane (53) is contoured to pivotably fit said slot (58). Main housing is manufactured in two symmetric parts (59 and 67) and joined sealingly along surface (68). Housing working volume (69) receives eccentric rotor (71) and rotor liner (55). Housing body also provides an internally hollow volume to allow space for the pivoting motion of the hinged (74) arc vane (53).

The top (60) and bottom (76) plates is holding tightly both housing parts body (59 and 67) through threaded rods and bolts passing through housing and end plate holes (75, 68 and 65). Both end plates (60 and 76) are apertured (66) to allow for the rotor (71) drive shaft ends (70 and 56) to be journalled (77) by end plate bearings (48 and 64). Said end bearings are bolted to end plates through surfaces (62) having bolt holes (63). The arc vane pivot rod (54) is also journalled (49) to both said end plates at respective aperture (51) using bearings (50 and 61) bolted (52) to end plates. The pivoting rod bearings (50,61) allows pivoting motion of arc vane but strictly restrict any axial displacement parallel to pivot rod (54). Hence, with exacts calculation of pivot rod length and a provision for a predetermined working gap between pivoting arc vane (53) and end plates (76 and 60), any sliding friction between said elements is eliminated.

Rotor (71) is rotatably and circumferentially housed (72) within rotor liner (55) which is movably hinged (73) to arc vane link (74). In case of a rotary expander, a periodic sequence of expanded fluid is delivered from the exhaust port (57) with each rotation of the eccentric rotor in response to high pressure and temperature fluid expansion in said expander. The exhaust gas pressure is lowered to about designed minimum pressure values to allow maximum shaft work extraction and increase in thermal efficiency. The maximum crescent shape volume of the expander chamber is sized such that the inlet fluid pressure is expanded to designed discharge pressure.

Figure 5:
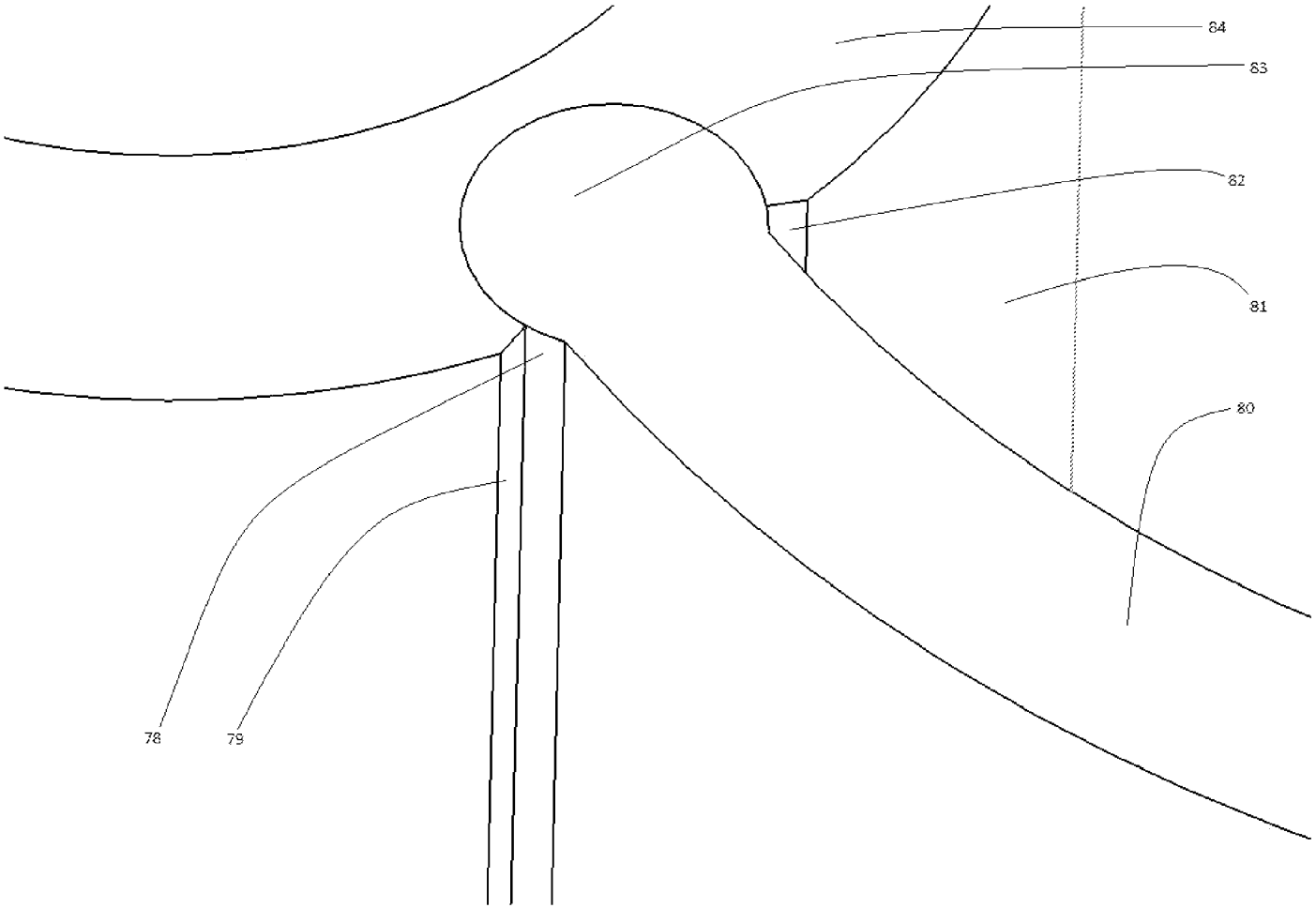
FIG. 5: Magnified view of hinged arc vane movingly engaged within rotor liner hinge cavity.

FIG. 5 depicts an embodiment of the hinge (80) engaging across its entire height (78) to the rotor liner (81). The arc vane (80) is slidingly assembled to rotor liner (84) and because the extent of tangency of the vane hinge (83) and matching rotor liner cavity covers a circular arc in excess of 181°, arc vane hinge cannot disengage from rotor liner cavity during working operation of the unit. Both rotor liner end surface (84) and hinge (83) are flush mounted to avoid working fluid leakage across said rotor liner to eccentric rotor compartment. The two sides (82 and 79) of hinge cavity are contoured to allow pivoting motion of the arc vane during 360° rotation of the eccentric rotor. Said side surfaces (82,79) are chamfered so that the pivoting vane is not caught or snagged against the rotor liner cylindrical surface (81).

Figure 6:
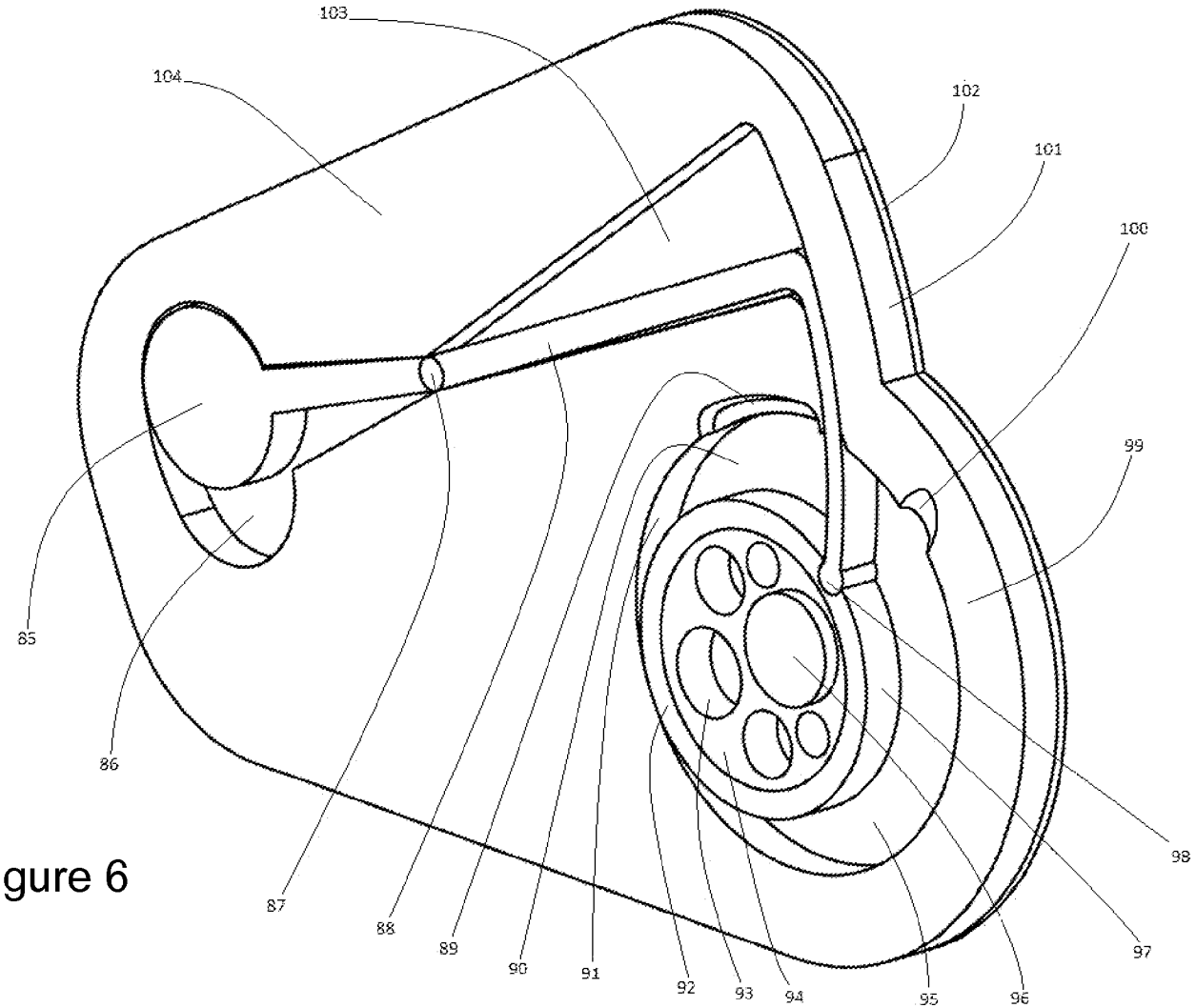
FIG. 6: Perspective view of balanced hinged arc vane compressor or expander device.

FIG. 6 depicts preferred embodiment of dynamically balanced pivoting hinged vane rotary compressor or expander unit.

Figure 7:
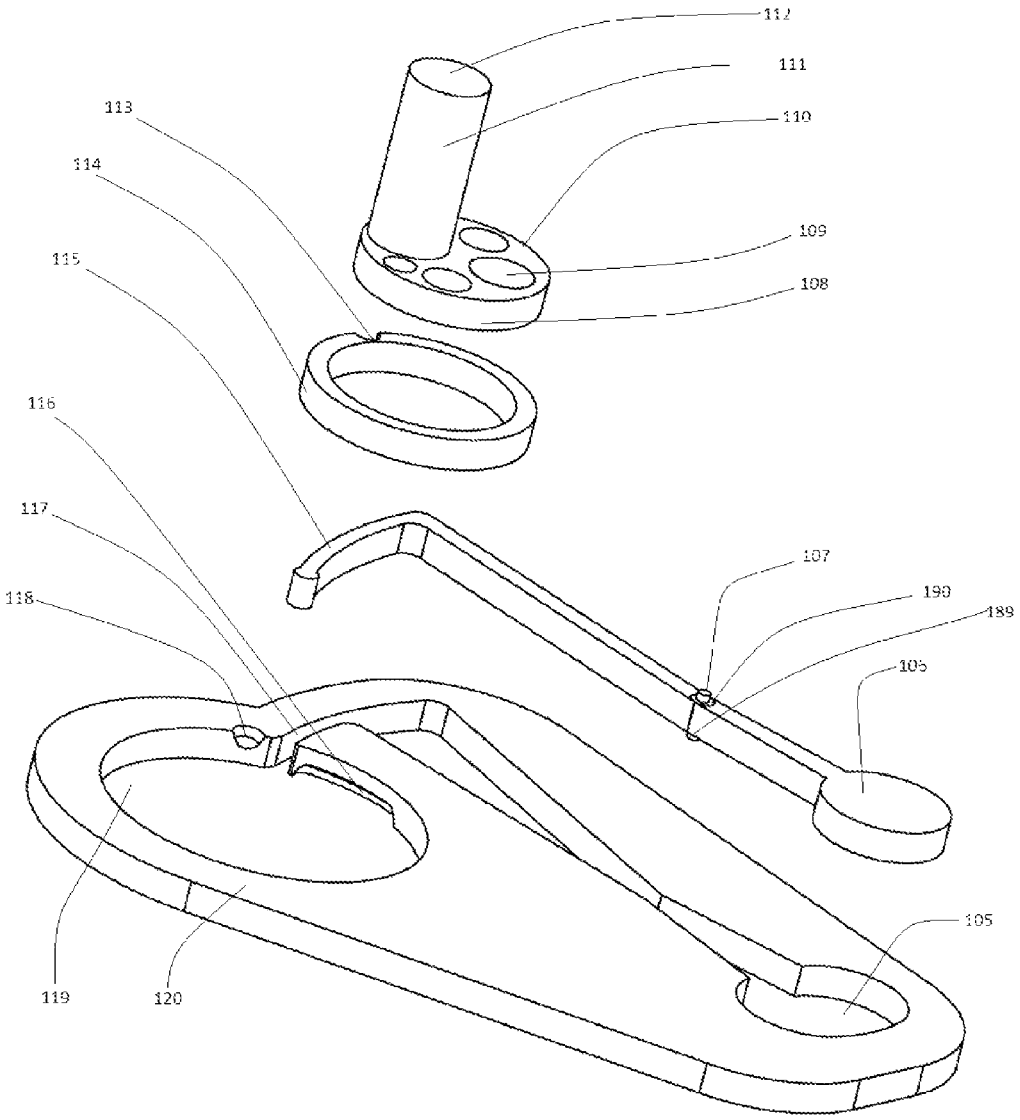
FIG. 7: Exploded view of balanced hinged arc vane without end plates.
Figure 8:
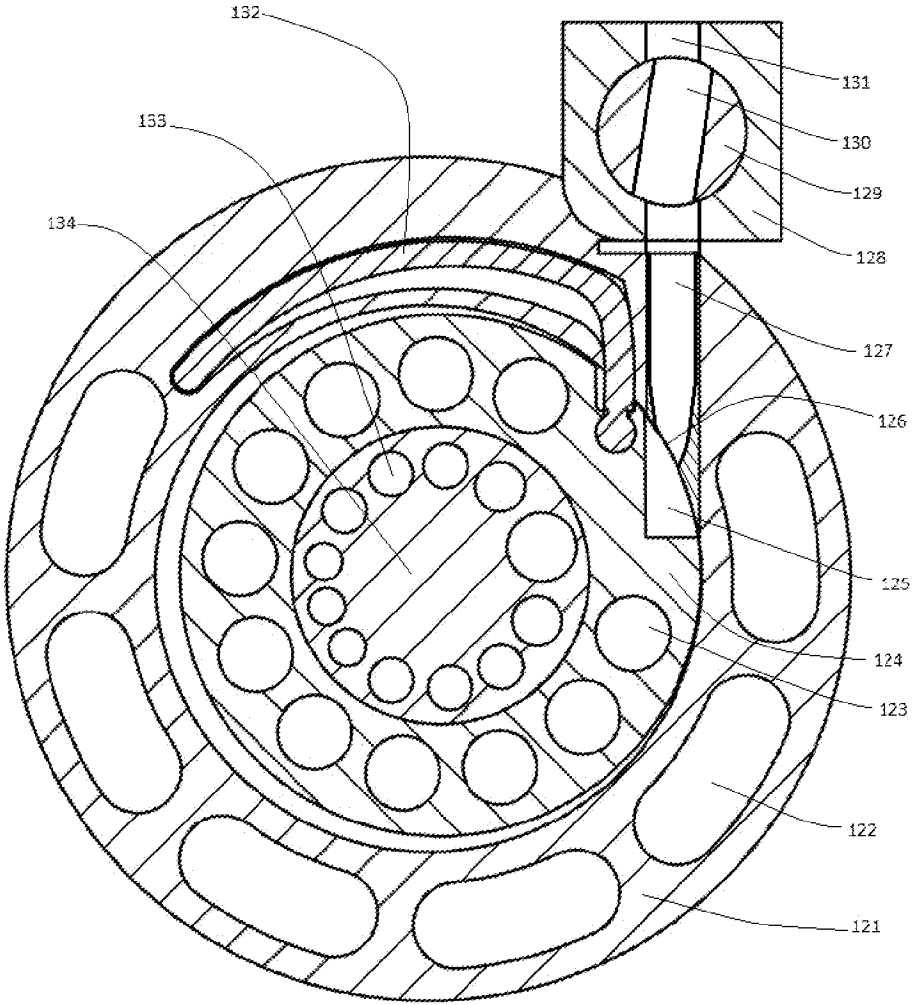
FIG. 8: Top view of pivoting arc vane expander device with rotating valve, inlet nozzle and impulse bucket cavity cross section within rotor liner.
Figure 9:
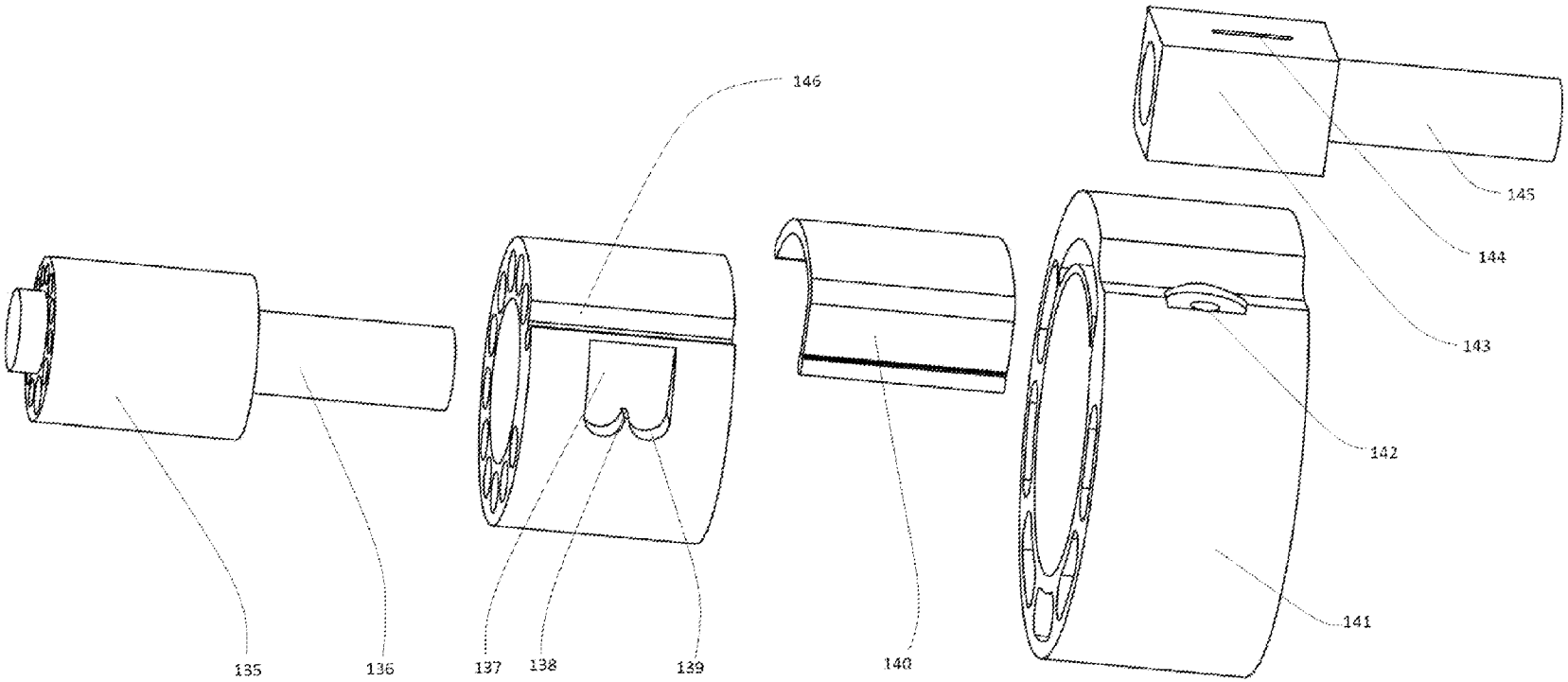
FIG. 9: Exploded view of eccentric rotor, rotor liner with impulse bucket cavity, pivoting arc vane, housing and inlet rotating valve.
Figure 10:
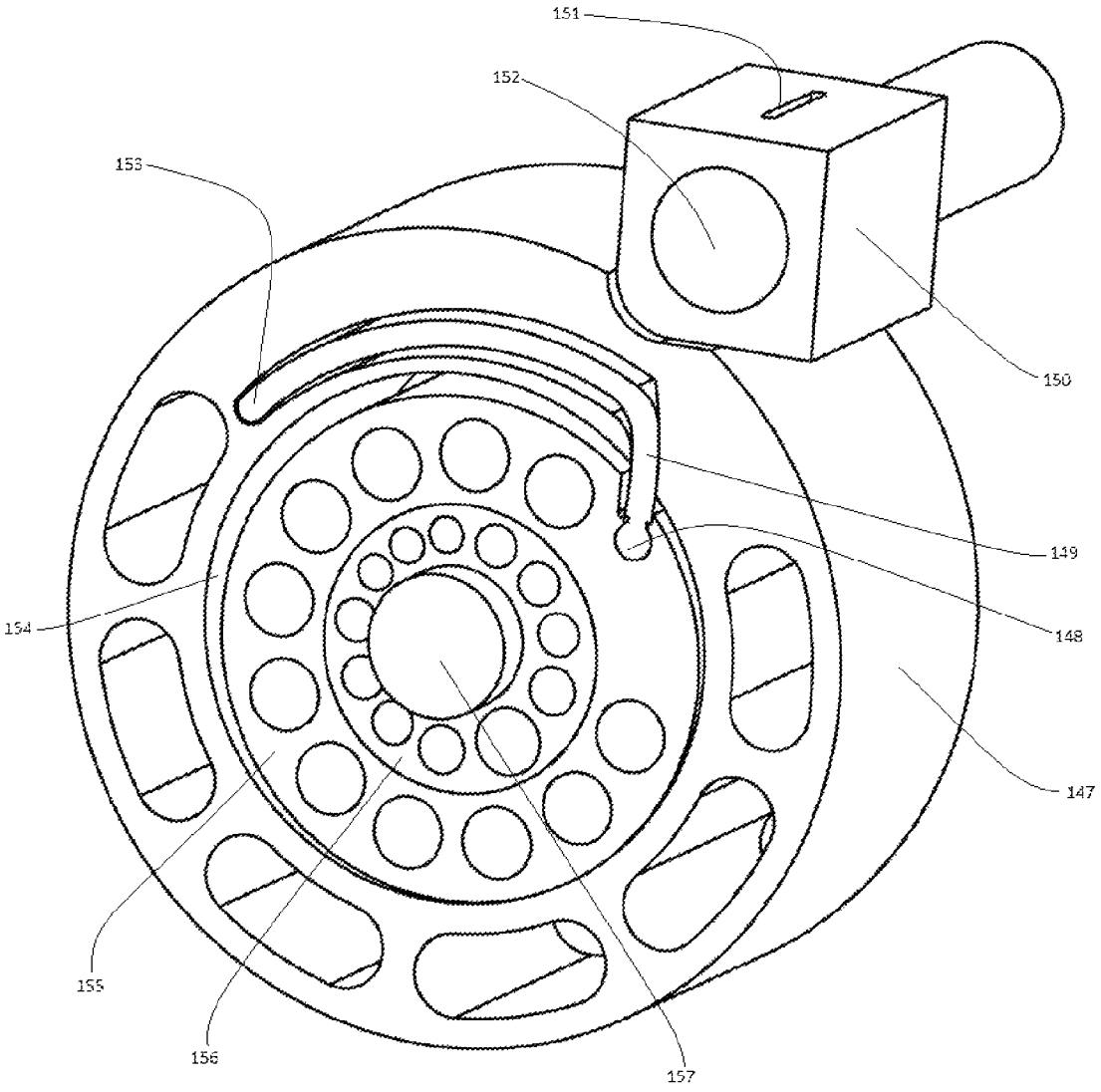
FIG. 10: Perspective view of pivot vane expander device with inlet rotating valve.
Figure 11:
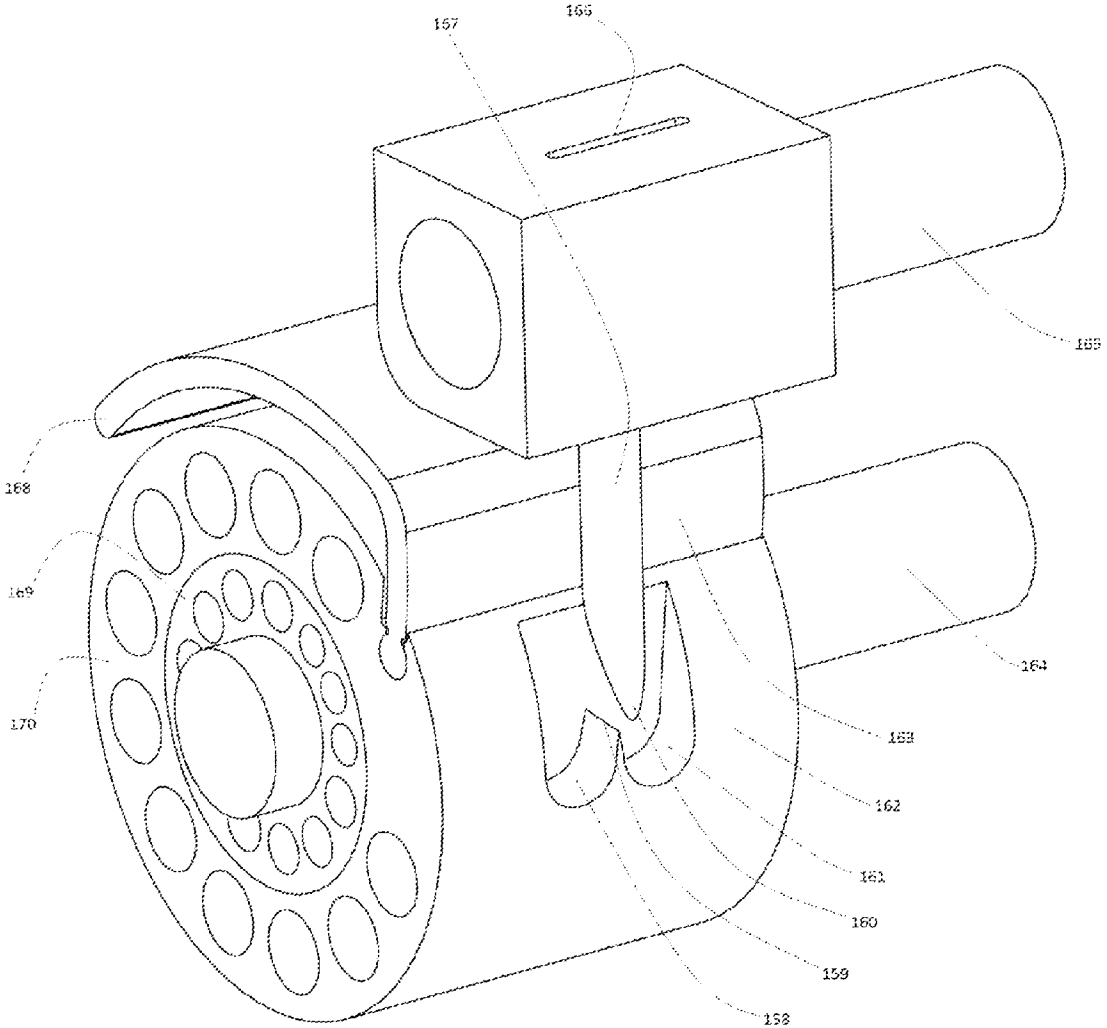
FIG. 11: Perspective view of pivot vane expander device showing inlet rotating valve, inlet nozzle and impulse bucket cavity on the rotor liner. Main housing has been removed to show unit internal details.

FIG. 7 shows the exploded view of the same embodiment. In these two figures, the added weight (85,106) balances the arc vane (115) and pivot arm (88) around pivot centre (87, 107). The internally hollow volume (86, 103, 105) (mentioned but not shown in FIG. 4) within the housing side body (104) allowing pivoting space of the arc vane is clearly pictured in these embodiments. One of the end plate (102) is seen attached to housing (101,120). Main shaft (96,111) centre (112) is rigidly connected to eccentric rotor (110,94). Said rotor is rotatably housed within cylindrical rotor liner (92, 114). Thus, the outer cylindrical surface (97) of rotor liner is always sealingly tangent to housing working chamber (119) inner peripheral (91) without any frictional contact.

Retaining rings (171, 172, 173, 174, 175, 176) may also be used on the rotor cylindrical surface (108) and on the rotor liner (92,114) inner circumferential peripheral. Said rings eliminate any axial displacement of the rotor liner parallel to main axis, thus eliminating any frictional motion between rotor liner (92,114) and end plates (102). Roller bearing or journal bearing may be used between rotor liner and eccentric rotor to reduce rotational frictions. The eccentric weight of the rotor is fully balanced with holes (93,109) drilled within rotor. The rotor liner is hinged (113) to arc vane hinge (98) in such a way that the rotor liner (92,114) is always in tangent to the cylindrical volume (119) inner peripheral (91) of the main housing (99). The arc vane is sealingly extending from housing slot (117) and is hinged to rotor liner (92,114) to divide the crescent shape volume into two consecutive working chambers (95 and 90). If the rotation of main rotor is clockwise facing FIG. 6, the hinged arc vane rotary compressor or expander is breathing in working fluid from inlet port (100,118) and discharging from outlet port (89,116). If the direction of the main rotor is reversed (counter clockwise facing FIG. 6), the roles assigned to ports are switched around and Port (89,116) becomes inlet port and port (100,118) becomes outlet port.

FIGS. 8, 9, 10, 11 and 12 are different perspectives of the same preferred embodiment. In these figures a rotating valve (128, 143, 150) is placed upstream of one of the port (126, 142) of the main housing (121, 141, 147, 180, 187). For the hinged arc vane rotary expander, port (126,142) is the inlet port accepting high pressure, high energetic working fluid. Fluid tubing is connected to entrance (131, 144, 151, 166). The rotating valve cylinder (129,152) driving shaft (145,165) is synchronised with main rotor shaft (136, 157, 164, 182) half speed either through mechanical belt pulley system or through an electrical motor and an encoder system. For every 360° of rotation of the rotating valve, the valve is open twice. The duration of opening is function of entrance slot (131, 144, 151, 166) width and the rotating valve slot (130) width. For hinged arc vane rotary expander, the working fluid is accelerated down the inlet nozzle (127,167). At nozzle exit (126, 160), fluid hits the impulse bucket (125,137) engraved in the rotor liner (124, 162, 178, 185). The fluid jet impulse is split by the bucket leading edge (138,159) and diverted by 180° in the two bucket cavities (139, 158, 161) to maximise the jet impulse momentum transfer to said rotor liner. As the rotating valve closes, the fluid jet fills the bucket cavity and the static pressure reaches maximum. As a result of this pressure built-up on the rotor liner (124, 155, 170) outer cylindrical surface, the eccentric rotor (134, 135, 156, 169) rotates. The high pressure is expanded in first working chamber and resulting low pressure fluid is sequentially expulsed through second working chamber (154) to outlet port. The rotary expander overall weight is decreased with housing cooling holes (122). Rotor liner dynamic balance holes (123) and rotor dynamic balance holes (133) not only contributes to a highly efficient vibration free operation but also to the weight decrease of the device. In this preferred embodiment the pivoting arc vane (132, 140, 149, 163, 179, 186) is operating tangentially to inlet fluid nozzle (127,167). The momentum initially imparted by the fluid hitting the rotor liner is first carried by the vane hinge (148), the vane pivot axis (153,168) and then transmitted to eccentric rotor (134, 135, 156, 169, 177, 184).

The invention includes the following concepts and features:

A rotary compressor or expander include a cylindrical housing chamber, a rotatable cylindrical rotor mounted eccentrically with respect to housing chamber centre, a cylindrical rotor liner free to move around the rotor, and a pivoting generally circular arc vane hinged to the rotor liner. Cavity or buckets engraved to the outer surface of the rotor liner together with corresponding inlet nozzle flow provide additional momentum impulse transfer from working fluid to expander eccentric rotor. The inlet of the rotary expander is equipped with a rotating valve synchronous to the eccentric rotor, regulating the admission time and duration of the entering working fluid. The exhaust of the rotary compressor is equipped with either a check valve or a rotating valve synchronising the fluid discharge time and duration.

In an exemplary embodiment, the rotary expander includes:

a housing having a generally cylindrical main chamber, a generally cylindrical rotatable rotor mounted eccentrically with respect to housing main chamber centre;

a generally cylindrical rotor liner free to move around the rotor and a single vane assembly comprised of an arched circular portion having a pivot axis fixed to housing side body and a hinge movably connecting said vane to the rotor liner. Therein;

Main shaft (96,111) centre (112) rigidly connected to eccentrically placed rotor (71, 94, 110). Said rotor rotatably and circumferentially housed (72) within cylindrical rotor liner (55, 92, 114).

Air or fluidic journal or roller bearings provided between rotor liner and eccentric rotor to reduce rotational friction.

Single arc vane element pivotally mounted to housing side body (104) and periodically extending sealingly from housing slot (117) into said main chamber (119) up to rotor liner (92,114) to divide the crescent shape volume into two consecutive working chambers (95 and 90). Said rotor liner movably hinged (73,113) to said arc vane (53) link (74) in such a way that outer cylindrical surface (97) of said rotor liner (92,114) is sealingly tangent to housing (99) working chamber (119) inner peripheral (91) without any frictional contact.

Crescent shape main housing chamber formed by inner peripheral of the housing (11) and outer surface of the rotor liner (7) being periodically divided into at most two working chambers (13 and 6) by the pivoting vane (1) and the common tangency line (9) of two osculating surfaces, namely the rotor liner (7) outer boundary and housing (11) cylindrical inner peripheral.

A plurality of working chambers (6, 13, 90, 95, 154) formed depending on the rotational position of the pivoting vane. Each of the said chambers, delimited by inner cylindrical peripheral surface of housing chamber, outer peripheral surface (97) of the rotor liner and the side surface (39) of the hinged arc vane.

Inlet port equipped with a rotating valve synchronous with main rotor shaft (136, 157, 164) half speed either mechanically or electrically, regulating the admission time and duration of the entering working fluid within rotary expander and thus preventing the said working fluid to bypass the working chambers and shortcut the inlet and outlet ports.

Inlet port formed in said housing for admitting high pressure and momentum inlet fluid flows into the working chamber delimited by the rotor liner, the housing cylindrical peripheral wall and the arc vane.

An inlet nozzle (127,167) downstream of rotating valve and accelerating fluid up to exit (126,160), where after working fluid hits impulse bucket (125,137) engraved in the rotor liner (124,162). Bucket provided with a leading edge (138,159), splitting and diverting fluid by 180° within bucket cavities (139, 158, 161) so as to maximise jet impulse momentum transfer to said rotor liner.

A single or a multiple of fluidic cavity or buckets engraved all along outer surface of the rotor liner together with corresponding single or multiple inlet nozzle to provide additional momentum impulse transfer from working fluid to rotor liner and eccentric rotor and achieve a higher stagnation pressure in working chamber.

A working cycle lasting for 360° clockwise rotation of eccentric rotor (8). Start of a new working cycle under the clockwise rotation of said rotor (8) every time the tangency line (9) passes by the inlet port (14). First working chamber (13) admitting high pressure fluid from inlet port (14) and expansion of the working fluid in said chamber (13) slidingly driving the eccentric rotor (8) under the forcing torque and pressure of admitted fluid. Working chamber (13) progressively enlarged to crescent shape like volume and expanding the admitted high pressure and momentum working fluid through.

A second working cycle defined in the consecutive 360° clockwise rotation of said rotor (8) allowing the fully expanded working fluid now in second working chamber (6) to discharge through exhaust port (15). Sizing the maximum crescent shape volume of the expander main chamber to allow the inlet fluid pressure expansion to desired discharge pressure.

A periodic sequence of expanded fluid expulsed from the outlet port (57) with each rotation of the eccentric rotor in response to high pressure and temperature fluid expansion in said expander.

Provision for geometrical gap between the pivot of the arched vane and end plates (181, 183, 188) adjusted with spacers (189, 190) so that friction contact of the arched vane with housing end plates during said vane reciprocating motion is reduced.

Retaining rings (171, 172, 173, 174, 175, 176) used on the rotor outer cylindrical surface (108) and on the rotor liner (92,114) inner circumferential peripheral. Said rings eliminating any axial displacement of the rotor liner parallel to main axis, thus reducing friction between rotor liner (92,114) and end plates (60,76).

Housing cooling holes (122) for steady long operation of the expander and for decrease of the weight of expander unit.

Rotor liner dynamic balance holes (123) and rotor dynamic balance holes (93, 109, 133) to reduce vibration during operation and to decrease overall weight.

Dynamic balance of the pivoting arc vane with added weight (85,106).

Figure 12:
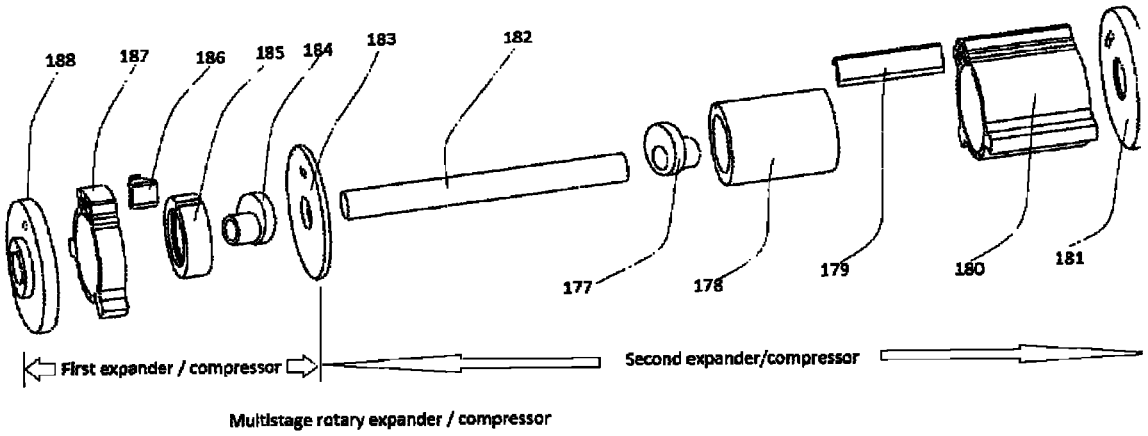
FIG. 12: Detailed view of multi-stage pivoting arc vane compressor or expander device

Further exemplary of the present invention, a multistage rotary expander in FIG. 12 combines multiple units of the aforementioned rotary expander in series in such a way that the output of one of the rotary expander is the input of a subsequent expander. Further exemplary, the first expander in FIG. 12 has a predetermined pressure, temperature and mass flow rate data input.

In an exemplary embodiment, the rotary compressor includes:

a housing having a generally cylindrical main chamber, a generally cylindrical rotatable rotor mounted eccentrically with respect to housing main chamber centre, and a generally cylindrical rotor liner free to move around the rotor and a single vane assembly comprised of an arched circular portion having a pivot axis fixed to the housing side body and a hinge movably connecting said vane to the rotor liner. As the eccentric rotor rotates, the pivoting arc vane is rocking back and forth around its pivot, forcing the rotor liner to perform an elliptical like motion.

Therein;

Main shaft (96,111) centre (112) rigidly connected to eccentrically placed rotor (71, 94, 110). Said rotor rotatably and circumferentially housed (72) within cylindrical rotor liner (55, 92, 114).

Air or fluidic journal and roller bearing provided between rotor liner and eccentric rotor to reduce rotational friction.

Single arc vane element pivotally mounted to the housing side body (104) and periodically extending sealingly from housing slot (117) into said main chamber (119) up to rotor liner (92,114) to divide the crescent shape volume into two consecutive working chambers (95 and 90). Said rotor liner movably hinged (73,113) to said arc vane (53) link (74) in such a way that outer cylindrical surface (97) of said rotor liner (92,114) is sealingly tangent to housing (99) working chamber (119) inner peripheral (91) without any frictional contact.

Crescent shape main housing chamber formed by the inner peripheral of the housing (11) and the outer surface of the rotor liner (7) being periodically divided into at most two working chambers (13 and 6) by the pivoting vane (1) and the common tangency line (9) of two osculating surfaces, namely the rotor liner (7) outer boundary and the housing (11) cylindrical inner peripheral.

A plurality of working chambers (6, 13, 90, 95, 154) formed depending on the rotational position of the pivoting vane. Each of the said chambers, delimited by the inner cylindrical peripheral surface of the housing chamber, outer peripheral surface (97) of the rotor liner and the side surface (39) of the hinged arc vane.

Outlet port equipped with a check-valve or a rotating valve synchronous with main rotor shaft (136, 157, 164) half speed either mechanically or electrically, regulating the exhaust time and duration of the high pressure leaving working fluid from rotary compressor and thus preventing the said working fluid to bypass the working chambers and shortcut the inlet and outlet ports of such devices.

Inlet port formed in said housing for admitting ambient pressure fluid flows into the working chamber delimited by the rotor liner, the housing cylindrical peripheral wall and the arc vane.

Impulse bucket engraved in the rotor liner (124,162) so as to maximise exhaust pressure and mass flow rate.

A single or a multiple of fluidic cavity or buckets engraved all along the outer surface of the rotor liner to achieve a higher stagnation pressure in second working chamber next to outlet port.

A working cycle lasting for 360° clockwise rotation of eccentric rotor (8). Start of a new working cycle under the clockwise rotation of said rotor (8) every time the tangency line (9) passes by the inlet port (14). First working chamber (13) admitting ambient pressure fluid from inlet port (14) for the entire duration of the first 360° clockwise rotation of eccentric rotor.

A second working cycle defined in the consecutive 360° clockwise rotation of said rotor (8) compressing the working fluid, now in the second working chamber (6), by a continuously diminishing chamber working volume to high pressure and discharging it through exhaust port (15). Sizing the maximum crescent shape volume of the compressor main chamber to allow the outlet fluid pressure to reach desired high discharge pressure values.

A periodic sequence of compressed fluid discharged from the outlet port (57) with each rotation of the eccentric rotor in response to input driving torque and circumferential speed of main rotor shaft in said compressor.

The exhaust of rotary compressors equipped with either a check valve or a rotating valve again synchronising the fluid discharge time and duration and strictly preventing any pressurized working fluid to enter back the working chamber from the exhaust port.

Provision for geometrical gap between the pivot of the arched vane and end plates adjusted with spacers (189, 190) so that friction contact of the arched vane with housing end plates during said vane reciprocating motion is reduced.

Retaining rings (171, 172, 173, 174, 175, 176) used on the rotor outer cylindrical surface (108) and on the rotor liner (92,114) inner circumferential peripheral. Said rings eliminating any axial displacement of the rotor liner parallel to main axis, thus reducing friction between rotor liner (92,114) and end plates (60,76).

Housing cooling holes (122) for steady long operation of the compressor and for decrease of the weight of compressor unit.

Rotor liner dynamic balance holes (123) and rotor dynamic balance holes (93, 109, 133) to reduce vibration during operation and decrease overall weight.

Dynamic balance of the pivoting arc vane with added weight (85,106).

Further exemplary of the present invention, a multistage rotary compressor in FIG. 12 combines multiple units of the aforementioned rotary compressor in series in such a way that the output of one of rotary compressors is the input of the subsequent compressor. Further exemplary, the first compressor in FIG. 12 has a predetermined pressure, temperature and mass flow rate data input.

The present patent have many geometric and aerothermodynamics improvements and extensions over the following prior arts: U.S. Pat. No. 7,314,035, Turkish Patents 2006/03859 and 2005/02164. In these prior arts, the peripheral of the housing which delimits the working chamber circumscription is elliptic, therefore it is more expensive to manufacture. Furthermore, the straight single vane disclosed in these prior arts is forced to rotate at high rotor speed thus causing an aerodynamic blunt body drag force and resistance to the displacing working fluid flow within the housing chambers, a situation very similar to that of the linear piston driven fluid flow within well known internal combustion engine cylinder.

In the present invention, the single vane is operating just as a side boundary moving alongside the displacing fluid flow thus reducing shear force. As such, the fluid flow within the working chamber is mainly not perpendicular to the pivoting hinged vane and the resulting vane drag is greatly reduced. Also, the housing inner peripheral is cylindrical and not elliptical, thus it is easier to manufacture with increased manufacturing accuracy.

There are many pivot vane and hinged vane rotary devices such as described in U.S. Pat. No. 7,117,841 by Kernes, U.S. Pat. No. 6,868,822 by Di Pietro, U.S. Pat. No. 6,125,814 by Tang, U.S. Pat. No. 5,692,887 by Krueger, U.S. Pat. No. 6,371,745 by Bassine, U.S. Pat. No. 5,616,019 by Hattori, U.S. Pat. No. 5,188,524 by Bassine, U.S. Pat. No. 5,163,825 by Oetting, U.S. Pat. No. 4,060,342 by Delmar, US 2003/0159673 by King, U.S. Pat. No. 4,060,342 by Riffe. But none of them exhibit a pivoting arc vane that is also hinged to the rotor liner as described by current invention.

Also none of prior arts exhibits a single or a multitude of fluidic buckets for compressible flow engraved within the rotor liner similar to well known Pelton hydraulic turbine buckets for incompressible flows. A single or a multitude of cavity or buckets engraved to the outer surface of the rotor liner together with corresponding single or multitude inlet nozzle flow are to provide additional momentum impulse transfer from working fluid to eccentric rotor and achieve a higher stagnation pressure as well.

Most of the other prior provision of vane assemblies include a straight blade portion—not arched—and a pivotal shoe portion on the distal edge of the blade in rotary devices such as pumps, engine, compressors, turbines and expanders as evidence by U.S. Pat. No. 40,008, U.S. Pat. No. 832,848, U.S. Pat. No. 2,458,620, U.S. Pat. No. 3,193,192. In each of these patents there is a disclosed vane assembly with a blade and shoe joined in a cylinder and socket type joint. However, in each of those cases, the vane is sliding back and forth on a linear path with increased friction and wear within its housing as the differential pressure among adjacent working chambers increase. The pivot vane described by Firestone in U.S. Pat. No. 5,616,020 refers to a configuration where the hinge is on the rotor and not on the rotor liner. Hence the rotor liner in said patent is protruded by vanes and this configuration will eventually lead to pressure seal problems in said location. Similarly the hinged vane configuration disclosed in U.S. Pat. No. 6,722,856 by Schneider also reveals a configuration where multiple vanes are hinged to the rotor and protruding the rotor liner likely to cause rotor liner pressure seal problem.

In the past, there have been several rotary vane pumps disclosed in the prior arts, including those disclosed in U.S. Pat. Nos. 4,011,033; 4,061,450; 4,019,840 and 4,073,608 for positive displacement vane-type rotary pumps, incorporated herein for reference. These prior art pumps have vane members which extend radially outwardly from and are connected to a rotor mechanism so that upon rotation of the rotor the vanes move a uniform distance through an arc to pump fluid in the pumping channel from the inlet port to the outlet port. None of these patents claim the presence of a pivoting single arc vane hinged to rotor liner. Prior arts disclosed in U.S. Pat. Nos. 5,007,813; 5,716,201; 6,371,745 B1 also do not claim the presence of an arc vane with a pivot centre located within the rotor housing and a hinged linkage with the rotor liner. Such rotary vane device has a regularly reported sealing difficulties and claim solutions about such difficulty in maintaining a good seal between high and low working chambers separated by vanes. Other reported rotary vane devices have also the following series of problems: 1) The vanes are expensive to built. 2) It is difficult to maintain a good seal between all the chambers of the device. 3) The required pressure for an efficient engine are higher than that required in the internal combustion engine.

Up to the present invention, no solution was presented to the problem of designing the vanes so that their lateral surfaces contour provide a complete sealed engagement throughout the entire paths of travel of said elements during the operation of the device. The arrangement of the invention according to this application is considered to be superior to those disclosed in the related application in that significantly lower wear and friction levels are achieved between the housing slot and the vane. Since there is virtually very little friction between reciprocating vane, rotating eccentric shaft and fixed housing slot parts, the gap tolerances can be lower and subsequently higher pressure differentials between the compression space and the suction space in a rotary compressor can be reached with the present invention.

Similarly in the rotary vane expander, higher pressure expansion ratios and efficiencies can be achieved with minimum leak. The gap between the pivot of the arched vane and end plates can easily be adjusted with washers and spacers (189,190) so that any friction contact of the arched vane with housing end plates during its reciprocating motion is eliminated as well. Provision of retaining ring (171, 172, 173, 174, 175, 176) between the eccentric rotor and the rotor liner also eliminates the contact friction of rotor liner with housing end plates. Dynamic balance of the rocking arched vane and rotating eccentric shaft are achieved independently from each other allowing great ease during assembly and maintenance of the device. Dynamic balance of every mechanical parts in motion mainly assures vibration free operation of rotary vane compressors and expanders. The vibration free operation allows a longer life of all shaft bearings and also secures the designed tolerances between moving and fixed parts to be valid for longer operating hours. This feature extends the nominal performance of compressors or expanders covered by this invention to almost all the operating lifetime span of those devices if regular scheduled maintenance are carried out.

The related patent application mainly discloses a pivoting vane-hinged rotor liner cylinder arrangement. The advantage of this arrangement over the prior art is the elimination of vane-rolling piston cylinder surface friction. In the present invention all subjected forces are transmitted to the hinge and pivot joints with no surface friction. The arched vane geometry also increases the structural strength of the vane and such configuration bears much higher loads than a conventional flat hinged vane. As such, if arched vane is cut out from a cylinder, the manufacturing cost will be kept at a minimum as well.

Although specific features of the invention are shown in some drawings and nor others, this is for convenience only as each feature may be combined with any or all of the other features in accordance with the invention. Other embodiments will occur to those skilled in the art and are within the following claims

The invention claimed is:

1. A rotary expander, comprising:

a housing having a generally cylindrical main chamber, a generally cylindrical rotatable rotor mounted eccentrically with respect to housing main chamber centre;

a generally cylindrical rotor liner free to move around the rotor and a single vane assembly comprised of an arched circular portion having a pivot axis fixed to a housing side body and a hinge movably connecting said vane to the rotor liner, the rotary expander further including:

a main shaft centre rigidly connected to eccentrically placed rotor, said rotor rotatably and circumferentially housed within cylindrical rotor liner;

air or fluidic journal or roller bearings provided between rotor liner and eccentric rotor to reduce rotational friction;

a single arc vane element pivotally mounted to the housing side body and periodically extending sealingly from housing slot into said main chamber up to rotor liner to divide the crescent shape volume into two consecutive working chambers, said rotor liner movably hinged to said arc vane link in such a way that outer cylindrical surface of said rotor liner is sealingly tangent to housing working chamber inner peripheral without any frictional contact;

a crescent shape a main housing chamber formed by an inner peripheral of housing and an outer surface of the rotor liner being periodically divided into at most two working chambers by the pivoting vane and the common tangency line of two osculating surfaces, namely the rotor liner outer boundary and a housing cylindrical inner peripheral;

a plurality of working chambers formed depending on the rotational position of the pivoting vane, each of the said chambers, delimited by an inner cylindrical peripheral surface of an, outer peripheral surface of the rotor liner and the side surface of the hinged arc vane;

an inlet port equipped with a rotating valve synchronous with main rotor shaft half speed either mechanically or electrically, regulating the admission time and duration of the entering working fluid within rotary expander and thus preventing the said working fluid to bypass the working chambers and shortcut the inlet and outlet ports of such devices;

an inlet port formed in said housing for admitting high pressure and momentum inlet fluid flows into the working chamber delimited by the rotor liner, a housing cylindrical peripheral wall and the arc vane;

an inlet nozzle downstream of rotating valve and accelerating fluid up to exit, where after working fluid hits impulse bucket engraved in the rotor liner, wherein a bucket is provided with a leading edge, splitting and diverting fluid by 180° within bucket cavities so as to maximise jet impulse momentum transfer to said rotor liner;

a single or a multiple of fluidic cavity or buckets engraved all along the outer surface of the rotor liner together with corresponding single or multiple inlet nozzle to provide additional momentum impulse transfer from working fluid to rotor liner and eccentric rotor and achieve a higher stagnation pressure in working chamber;

a working cycle lasting for 360° clockwise rotation of eccentric rotor, wherein a new working cycle under the clockwise rotation of said rotor is initiated every time the tangency line passes by the inlet port, wherein a first working chamber admitting high pressure fluid from inlet port and expansion of the working fluid in said chamber imparts energy to the eccentric rotor under the forcing torque and pressure of admitted fluid, and wherein a working chamber is progressively enlarged to a crescent shape like volume and expanding the admitted high pressure and momentum working fluid through;

a second working cycle defined in the consecutive 360° clockwise rotation of said rotor allowing the fully expanded working fluid now in a second working chamber to discharge through exhaust port, wherein the maximum crescent shape volume of the expander main chamber is sized to allow the inlet fluid pressure expansion to desired discharge pressure;

a periodic sequence of expanded fluid expulsed from the outlet port with each rotation of the eccentric rotor in response to high pressure and temperature fluid expansion in said expander;

provision for geometrical gap between the pivot of the arched vane and end plates adjusted with spacers so that friction contact of the arched vane with housing end plates during said vane reciprocating motion is reduced;

retaining rings used on the rotor outer cylindrical surface and on the rotor liner inner circumferential peripheral, wherein said rings operate to eliminate any axial displacement of the rotor liner parallel to main axis, thus reducing friction between rotor liner and end plates;

housing cooling holes for steady long operation of the expander and for decrease of the weight of expander unit;

rotor liner dynamic balance holes and rotor dynamic balance holes to reduce vibration during operation and to decrease overall weight; and a dynamic balance of the pivoting arc vane with added weight.

2. A multistage rotary expander combining a plurality of rotary expanders in such a way that the output of one of a first rotary expander is the input of a second rotary expander, wherein each of the first and second rotary expanders comprise:

a housing having a generally cylindrical main chamber, a generally cylindrical rotatable rotor mounted eccentrically with respect to housing main chamber centre;

a generally cylindrical rotor liner free to move around the rotor and a single vane assembly comprised of an arched circular portion having a pivot axis fixed to a housing side body and a hinge movably connecting said vane to the rotor liner, the rotary expander further including:

a main shaft centre rigidly connected to eccentrically placed rotor, said rotor rotatably and circumferentially housed within cylindrical rotor liner;

air or fluidic journal or roller bearings provided between rotor liner and eccentric rotor to reduce rotational friction;

a single arc vane element pivotally mounted to the housing side body and periodically extending sealingly from housing slot into said main chamber up to rotor liner to divide the crescent shape volume into two consecutive working chambers, said rotor liner movably hinged to said arc vane link in such a way that outer cylindrical surface of said rotor liner is sealingly tangent to housing working chamber inner peripheral without any frictional contact;

a crescent shape main housing chamber formed by an inner peripheral of housing and an outer surface of the rotor liner being periodically divided into at most two working chambers by the pivoting vane and the common tangency line of two osculating surfaces, namely the rotor liner outer boundary and housing cylindrical inner peripheral;

a plurality of working chambers formed depending on the rotational position of the pivoting vane, each of the said chambers, delimited by inner cylindrical peripheral surface of housing chamber, outer peripheral surface of the rotor liner and the side surface of the hinged arc vane;

an inlet port equipped with a rotating valve synchronous with main rotor shaft (136, 157, 164) half speed either mechanically or electrically, regulating the admission time and duration of the entering working fluid within rotary expander and thus preventing the said working fluid to bypass the working chambers and shortcut the inlet and outlet ports;

an inlet port formed in said housing for admitting high pressure and momentum inlet fluid flows into the working chamber delimited by the rotor liner, housing cylindrical peripheral wall and the arc vane;

an inlet nozzle downstream of rotating valve and accelerating fluid up to exit, where after working fluid hits impulse bucket engraved in the rotor liner, wherein a bucket is provided with a leading edge, splitting and diverting fluid by 180° within bucket cavities so as to maximise jet impulse momentum transfer to said rotor liner;

a single or a multiple of fluidic cavity or buckets engraved all along the outer surface of the rotor liner together with corresponding single or multiple inlet nozzle to provide additional momentum impulse transfer from working fluid to rotor liner and eccentric rotor and achieve a higher stagnation pressure in working chamber;

a working cycle lasting for 360° clockwise rotation of eccentric rotor, wherein a new working cycle under the clockwise rotation of said rotor is initiated every time the tangency line passes by the inlet port, wherein a first working chamber admitting high pressure fluid from inlet port and expansion of the working fluid in said chamber imparts energy to the eccentric rotor under the forcing torque and pressure of admitted fluid, and wherein a working chamber is progressively enlarged to a crescent shape like volume and expanding the admitted high pressure and momentum working fluid through;

a second working cycle defined in the consecutive 360° clockwise rotation of said rotor allowing the fully expanded working fluid now in a second working chamber to discharge through exhaust port, wherein the maximum crescent shape volume of the expander main chamber is sized to allow the inlet fluid pressure expansion to desired discharge pressure;

a periodic sequence of expanded fluid expulsed from the outlet port with each rotation of the eccentric rotor in response to high pressure and temperature fluid expansion in said expander;

provision for geometrical gap between the pivot of the arched vane and end plates adjusted with spacers so that friction contact of the arched vane with housing end plates during said vane reciprocating motion is reduced;

retaining rings used on the rotor outer cylindrical surface and on the rotor liner inner circumferential peripheral, wherein said rings operate to eliminate any axial displacement of the rotor liner parallel to main axis, thus reducing friction between rotor liner and end plates;

housing cooling holes for steady long operation of the expander and for decrease of the weight of expander unit;

rotor liner dynamic balance holes and rotor dynamic balance holes to reduce vibration during operation and to decrease overall weight; and a dynamic balance of the pivoting arc vane with added weight.

3. The multistage rotary expander of claim 2, wherein the first expander has a predetermined pressure, temperature and mass flow rate data input.

4. A rotary compressor, comprising:

a housing having a generally cylindrical main chamber, a generally cylindrical rotatable rotor mounted eccentrically with respect to housing main chamber centre;

a generally cylindrical rotor liner free to move around the rotor and a single vane assembly comprised of an arched circular portion having a pivot axis fixed to a housing side body and a hinge movably connecting said vane to the rotor liner, wherein as the eccentric rotor rotates, the pivoting arc vane is rocking back and forth around its pivot, forcing the rotor liner to perform an elliptical-like motion, the rotary compressor further comprising:

a main shaft centre rigidly connected to eccentrically placed rotor, wherein said rotor is rotatably and circumferentially housed within cylindrical rotor liner;

an air or fluidic journal and roller bearing provided between rotor liner and eccentric rotor to reduce rotational friction;

a single arc vane element pivotally mounted to the housing side body and periodically extending sealingly from housing slot into said main chamber up to rotor liner to divide the crescent shape volume into two consecutive working chambers, wherein said rotor liner is movably hinged to said arc vane link in such a way that outer cylindrical surface of said rotor liner is sealingly tangent to housing working chamber inner peripheral without any frictional contact;

a crescent shape main housing chamber formed by an inner peripheral of housing and an outer surface of the rotor liner being periodically divided into at most two working chambers by the pivoting vane and the common tangency line of two osculating surfaces, namely the rotor liner outer boundary and housing cylindrical inner peripheral;

a plurality of working chambers formed depending on the rotational position of the pivoting vane, wherein each of the said chambers, delimited by inner cylindrical peripheral surface of housing chamber, outer peripheral surface of the rotor liner and one of the arched side surface of the hinged arc vane;

an outlet port equipped with a check-valve or a rotating valve synchronous with main rotor shaft half speed either mechanically or electrically, regulating the exhaust time and duration of the high pressure leaving working fluid from rotary compressor and thus preventing the said working fluid to bypass the working chambers and shortcut the inlet and outlet ports;

an inlet port formed in said housing for admitting ambient pressure fluid flows into the working chamber delimited by the rotor liner, housing cylindrical peripheral wall and the arc vane;

an impulse bucket engraved in the rotor liner so as to maximise exhaust pressure and mass flow rate;

a single or a multiple of fluidic cavity or buckets engraved all along the outer surface of the rotor liner to achieve a higher stagnation pressure in a second working chamber next to outlet port;

a working cycle lasting for 360° clockwise rotation of eccentric rotor, wherein a new working cycle under the clockwise rotation of said rotor is started every time the tangency line passes by the inlet port, and wherein a first working chamber admits ambient pressure fluid from inlet port for the entire duration of the first 360° clockwise rotation of eccentric rotor;

a second working cycle defined in the consecutive 360° clockwise rotation of said rotor compressing the working fluid, now in a second working chamber, by a continuously diminishing chamber working volume to high pressure and discharging it through exhaust port, wherein the maximum crescent shape volume of the compressor main chamber is sized to allow the outlet fluid pressure to reach desired high discharge pressure values;

a periodic sequence of compressed fluid discharged from the outlet port with each rotation of the eccentric rotor in response to input driving torque and circumferential speed of main rotor shaft in said compressor;

wherein the exhaust of rotary compressors are equipped with either a check valve or a rotating valve again synchronising the fluid discharge time and duration and strictly preventing any pressurized working fluid to enter back the working chamber from the exhaust port;

a provision for geometrical gap between the pivot of the arched vane and end plates adjusted with spacers so that friction contact of the arched vane with housing end plates during said vane reciprocating motion is reduced;

retaining rings used on the rotor outer cylindrical surface and on the rotor liner inner circumferential peripheral, wherein said rings are operable to eliminate any axial displacement of the rotor liner parallel to main axis, thus reducing friction between rotor liner and end plates;

housing cooling holes for steady long operation of the compressor and for decrease of the weight of compressor unit;

rotor liner dynamic balance holes and rotor dynamic balance holes to reduce vibration during operation and decrease overall weight; and dynamic balance of the pivoting arc vane with added weight.

5. A multistage rotary compressor combining a plurality of rotary compressors in series in such a way that the output of one of a first rotary compressor is the input of a second rotary compressor, wherein each of the first and second rotary compressors comprise:

a housing having a generally cylindrical main chamber, a generally cylindrical rotatable rotor mounted eccentrically with respect to housing main chamber centre;

a generally cylindrical rotor liner free to move around the rotor and a single vane assembly comprised of an arched circular portion having a pivot axis fixed to a housing side body and a hinge movably connecting said vane to the rotor liner, wherein as the eccentric rotor rotates, the pivoting arc vane is rocking back and forth around its pivot, forcing the rotor liner to perform an elliptical-like motion, the rotary compressor further comprising:

a main shaft centre rigidly connected to eccentrically placed rotor, wherein said rotor is rotatably and circumferentially housed within cylindrical rotor liner;

an air or fluidic journal and roller bearing provided between rotor liner and eccentric rotor to reduce rotational friction;

a single arc vane element pivotally mounted to the housing side body and periodically extending sealingly from housing slot into said main chamber up to rotor liner to divide the crescent shape volume into two consecutive working chambers, wherein said rotor liner is movably hinged to said arc vane link in such a way that outer cylindrical surface of said rotor liner is sealingly tangent to housing working chamber inner peripheral without any frictional contact;

a crescent shape main housing chamber formed by an inner peripheral of housing and an outer surface of the rotor liner being periodically divided into at most two working chambers by the pivoting vane and the common tangency line of two osculating surfaces, namely the rotor liner outer boundary and housing cylindrical inner peripheral;

a plurality of working chambers formed depending on the rotational position of the pivoting vane, wherein each of the said chambers, delimited by inner cylindrical peripheral surface of housing chamber, outer peripheral surface of the rotor liner and one of the arched side surface of the hinged arc vane;

an outlet port equipped with a check-valve or a rotating valve synchronous with main rotor shaft half speed either mechanically or electrically, regulating the exhaust time and duration of the high pressure leaving working fluid from rotary compressor and thus preventing the said working fluid to bypass the working chambers and shortcut the inlet and outlet ports;

an inlet port formed in said housing for admitting ambient pressure fluid flows into the working chamber delimited by the rotor liner, housing cylindrical peripheral wall and the arc vane;

an impulse bucket engraved in the rotor liner so as to maximise exhaust pressure and mass flow rate;

a single or a multiple of fluidic cavity or buckets engraved all along the outer surface of the rotor liner to achieve a higher stagnation pressure in a second working chamber next to outlet port;

a working cycle lasting for 360° clockwise rotation of eccentric rotor, wherein a new working cycle under the clockwise rotation of said rotor is started every time the tangency line passes by the inlet port, and wherein a first working chamber admits ambient pressure fluid from inlet port for the entire duration of the first 360° clockwise rotation of eccentric rotor;

a second working cycle defined in the consecutive 360° clockwise rotation of said rotor compressing the working fluid, now in second working chamber, by a continuously diminishing chamber working volume to high pressure and discharging it through exhaust port, wherein the maximum crescent shape volume of the compressor main chamber is sized to allow the outlet fluid pressure to reach desired high discharge pressure values;

a periodic sequence of compressed fluid discharged from the outlet port with each rotation of the eccentric rotor in response to input driving torque and circumferential speed of main rotor shaft in said compressor;

wherein the exhaust of rotary compressors are equipped with either a check valve or a rotating valve again synchronising the fluid discharge time and duration and strictly preventing any pressurized working fluid to enter back the working chamber from the exhaust port;

a provision for geometrical gap between the pivot of the arched vane and end plates adjusted with spacers so that friction contact of the arched vane with housing end plates during said vane reciprocating motion is reduced;

retaining rings used on the rotor outer cylindrical surface and on the rotor liner inner circumferential peripheral, wherein said rings are operable to eliminate any axial displacement of the rotor liner parallel to main axis, thus reducing friction between rotor liner and end plates;

housing cooling holes for steady long operation of the compressor and for decrease of the weight of compressor unit;

rotor liner dynamic balance holes and rotor dynamic balance holes to reduce vibration during operation and decrease overall weight; and dynamic balance of the pivoting arc vane with added weight.

6. The multistage rotary compressor of claim 5, wherein the first compressor has a predetermined pressure, temperature and mass flow rate data input.

* * * * *